US008636549B2

(12) United States Patent
Pratt et al.

(10) Patent No.: US 8,636,549 B2
(45) Date of Patent: Jan. 28, 2014

(54) DYNAMIC CONTACT BAYONET ELECTRICAL CONNECTOR HAVING A SMALL CYLINDRICAL TIP AND A LARGER CONICAL MIDDLE PART

(75) Inventors: F. Dale Pratt, Calgary (CA); Kenneth A. Lambe, Calgary (CA)

(73) Assignee: Newsco Directional Support Services Inc., Calgary (CA)

( * ) Notice: Subject to any disclaimer, the term of this patent is extended or adjusted under 35 U.S.C. 154(b) by 0 days.

(21) Appl. No.: 13/326,129

(22) Filed: Dec. 14, 2011

(65) Prior Publication Data

US 2013/0157515 A1 Jun. 20, 2013

(51) Int. Cl.
*H01R 24/04* (2006.01)

(52) U.S. Cl.
USPC ..... 439/668

(58) Field of Classification Search
USPC ..... 439/42, 668–673
See application file for complete search history.

(56) References Cited

U.S. PATENT DOCUMENTS

| | | | | |
|---|---|---|---|---|
| 3,060,417 | A * | 10/1962 | Blake | 340/508 |
| 3,193,636 | A * | 7/1965 | Daniels | 200/51.12 |
| 3,665,509 | A * | 5/1972 | Elkins | 439/42 |
| 6,988,915 | B2 * | 1/2006 | Hirose | 439/668 |
| 7,052,297 | B2 | 5/2006 | Panzar et al. | |
| 7,083,474 | B1 * | 8/2006 | Fleck et al. | 439/668 |
| 7,131,844 | B1 | 11/2006 | Wurr | |
| 7,241,179 | B2 * | 7/2007 | Chennakeshu | 439/668 |
| 7,267,560 | B2 * | 9/2007 | Akino | 439/101 |
| 7,641,520 | B2 * | 1/2010 | Marino | 439/668 |
| 7,682,201 | B2 * | 3/2010 | Chen et al. | 439/668 |
| 2011/0098085 | A1 * | 4/2011 | Stenmark et al. | 455/557 |

FOREIGN PATENT DOCUMENTS

| | | |
|---|---|---|
| CA | 2554624 | 9/2006 |

* cited by examiner

*Primary Examiner* — Chandrika Prasad
(74) *Attorney, Agent, or Firm* — Bennett Jones LLP

(57) ABSTRACT

The present invention relates generally to multi-trace electrical connectors for harsh environments. More particularly, the present invention relates to bayonet rotary electrical connectors which maintain electrical connection dynamically, and which may have replaceable connector components. This type of connector is used, for example, in drilling operations where the connector must be rotated, for example during assembly, disassembly, or operation of bottom hole equipment or sensor or communications packages, and where the electrical connection may be maintained.

12 Claims, 9 Drawing Sheets

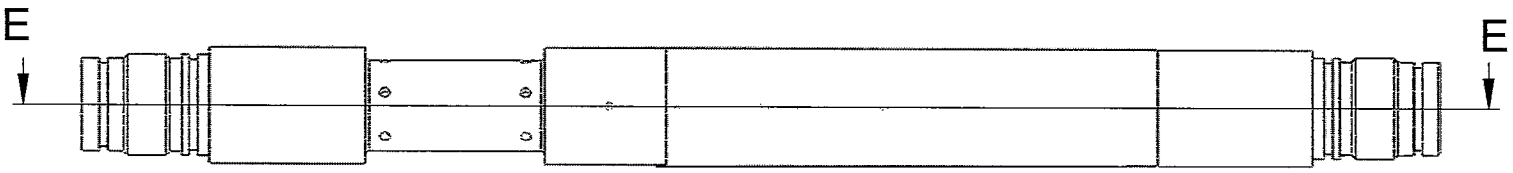
Figure 1
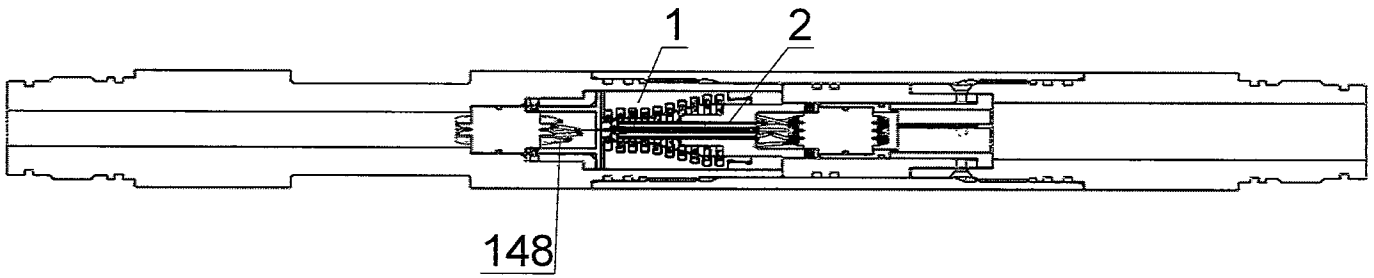
SECTION E-E

SECTION B-B

SECTION B-B

SECTION A-A

SECTION A-A

SECTION A-A

SECTION B-B

DYNAMIC CONTACT BAYONET ELECTRICAL CONNECTOR HAVING A SMALL CYLINDRICAL TIP AND A LARGER CONICAL MIDDLE PART

FIELD OF THE INVENTION

The present invention relates generally to multi-trace electrical connectors for harsh environments. More particularly, the present invention relates to bayonet rotary electrical connectors which maintain electrical connection dynamically, and which may have replaceable connector components. This type of connector is used, for example, in drilling operations where the connector must be rotated, for example during assembly, disassembly, or operation of bottom hole equipment or sensor or communications packages, and where the electrical connection may be maintained. The connector must be easily unplugged for service work or disassembly and reassembly of related or attached components, without special tools or facilities.

BACKGROUND OF THE INVENTION

In the prior art, a variety of conical or rotary bayonet-style connectors have been disclosed or are known. Each has disadvantages.

Blake (U.S. Pat. No. 3,060,417) discloses a conical connector with circular brushes and rings in a system of fire-detectors within an aircraft. Blake's connectors are static, meaning that when in operation, they do not rotate one against the other. The ring configuration is meant to permit the electrical connecting of two components by screwing them together, which necessitated (in this design) connectors which could be rotated in relation to each other during assembly. Blake's connector has a male conical end the outer surface of which has grooves with a metallic feature each connected to an external electronic, and in each groove is slidably positioned a metallic split ring in contact, when positioned, with the metallic feature. The female mating part (a conical receptacle) has deployed about its inner surface inner contact strips which touch the split rings when the male and female parts or screwed together for assembly. The conical nature of the parts is meant to compress the split rings against the contact strips to make and hold a good electrical connection, yet provide ease of disassembly and assembly. Blake's invention is static in the sense that it does not rotate when in use, but rather is held tight, one mating part static against the other. Blake is meant for deployment in fire-detection systems on aircraft requiring a robust but refittable connector system to easily assemble, disassemble and check, and reassemble a network of longitudinally spaced thermistor-based temperature sensors. Blake is not meant for harsh environments, or to maintain connection while its parts rotate in relation to each other during normal operation.

Elkins (U.S. Pat. No. 3,665,509) provides for an electrical connector set comprising a conical male connector and a mating conical receptacle to reliably and safely make electrical connections at great depths underwater. The male plug has contact rings deployed around its outer surface, perpendicular to its axis, and the female receptacle has connecting surfaces which match and correspond to the contact rings when the plug is seated in the receptacle. The male plug also has means to provide vacuum pressure differentials to the interface of the male and female components to assist them in mating, seating, sealing and maintaining their mated position. The plug, once seated, does not rotate in the socket. The invention is meant to provide a multi-trace electrical connection to a salvage pontoon which may be placed, seated, and secured in a static position sealed from intrusion of seawater, by a pressure differential introduced by lowering the fluid pressure in the space between the male and female components to a pressure below the ambient fluid pressure in the deep water within which the device is submerged when used. Elkins does not provide constant electrical connection during rotation of the two plug elements, and requires resilient seals and the provision of vacuum forces for its operation.

Wurr (U.S. Pat. No. 7,131,844) discloses a dynamic rotary electrical connector for use in applications such as providing electrical connections between a static device to wires within a cable on a rotating reel. It provides a series of flat washer-like metallic contact surfaces of consecutively smaller outer and inner diameter placed on a non-conducting circular body with increasingly smaller steps (from one end to the other), each step meant to hold one washer-like contact surface. The contact surfaces are connected to electrical traces within the stepped body, which is mounted to a fixture at the axis of a reel, with the contact surfaces facing the reel. A second part, holding brushes which are each sprung to be held in contact with a matching washer-like contact ring is mounted to the cable reel on the side of the reel facing the stepped body so that the brushes are biased to contact their matching contact ring and provide electrical connection from the static device through the stepped body's traces to the contact rings then to the brushes and from each brush to a wire within the cable for which the reel is made. Wurr's female (brush) component does nothing to assist in providing stable alignment along the rotational axis of the parts while under torsional stress longitudinally, and would fail should either part twist off its rotational axis relative to the other in providing continual electrical connection during rotation. Wurr is generally open to the environment Daniels (U.S. Pat. No. 3,193,636) provides a rotatable multiple-lead electrical connector with an essentially conical male plug with circumferential connector ring contacts embedded into the plug's outer surface, each shaped in cross-section as a "W"; and a matching conical female receptacle with internal circumferentially mating connectors comprised of multiple spring contact arms shaped in cross-section roughly as a "v", to engage the "V" shape with the "W" shape, so that the connector rings form a mechanism to retain male plug in the receptacle. When engaged, the male connector rings each connect with a mating spring-ring in the female receptacle. Electrical signals are provided to the female receptacle by wires within the non-conductive body of the receptacle affixed to the "V" shaped embedded spring contact arms, and to the male plug by wires through the plug's body and soldered to each "W" shaped ring connector. Further, each ring connector and each set of contact arms may be split into radial segments, each segment with its own electrical lead; in this way, partial rotation of the engaged plug or socket will change the electrical connection (from one set of mated radial ring segments to another set, on each of the male and female elements). Daniels refers to this as a "swivel type" connector. The connector rings in Daniels are not robust enough to provide long term service in harsh conditions. Their assembly is difficult, and the connector system cannot be easily repaired or replaced. The retention system of interlocking sprung connector rings will not provide sufficient force to bias the components together during some downhole drilling or similar operations. The generally comparatively fragile nature of the sprung contact arms in the female component are not suitable for downhole use in drilling operations or similar harsh conditions, longitudinal forces and bending forces.

Panzar (U.S. Pat. No. 7,052,297) discloses a rotary connector with removable/refittable contacts. A roughly cylindrical male plug is built-up of alternating insulator and conductor rings stacked on a central core which is a metal rod covered with an insulating layer. Wiring is provided to each connector ring by passing through each previously-stacked insulator and conductor ring. A mating receptacle is provided with conductors spaced within its cavity at circumferences spaced to match the spacing of the conductor rings on the plug, when assembled. Electrical ground is provided through the core's metal rod to a connector on the plug's tip end. The connectors either on the male plug's probe or within the receptacle's body are made of a springy, elastic circular contact which, when the plug is engaged and contacts are made, touches each of a conductor ring and female circumferential conductor in at least one spot to make electrical connection. The connection is kept when the plug is engaged whether or not the plug is rotated within the receptacle. Panzar requires holes to be made in each conductor and insulator ring prior to assembly, and then the alignment of each hole for insertion of electrical leads, which must be insulated since they pass through conductor rings to which they are not meant to connect. When any conductor or insulator ring rotates during use, there is a tendency for the holes through which the leads pass to misalign. Each time that occurs, a cutting stress is placed on the leads' insulator layer, and eventually, the lead will either become uninsulated at that point of contact with a conductor, or be severed. Since multiple holes are required to maintain constant alignment, and misalignment of one ring will cause multiple lead failures, Panzar suffers from a susceptibility in operation. Additionally, although Panzar's ground lead being at its tip makes some difference, by deploying multiple electrical leads along a cylindrical plug and inserting the plug into a cylindrical socket also with multiple leads, Panzar's system is susceptible to make unintended and undesirable circuit connections while being plugged or unplugged.

Other Prior Art Known as at Filing

See Canadian Application Serial Number 2554624, filed 1 Jun. 2005 at PCT with a U.S. equivalent at Ser. No. 10/925,672. A company named Greentweed <greentweed.com> makes or sells a rotary electrical connector with a two-part cross-sectional profile comprising two level segments with no conical segment.

It is desirable to have a reliable, repairable, easy to manufacture, safe and robust dynamic rotary multi-lead electrical connector for use in harsh conditions such as drilling operations, capable of making high voltage connections and withstanding much vibration, high temperature differentials in operating environments, and providing a mating mechanism which does not close unintended circuits during the plugging and unplugging of the connector.

It is, therefore, desirable to provide the improved dynamic contact bayonet electrical connector of this invention.

SUMMARY OF THE INVENTION

It is an object of the present invention to obviate or mitigate at least one disadvantage of previous related art.

The invention provides a bayonet rotary connector for making and breaking multiple electrical connections when respectively plugged and unplugged. The invention has a male component and a mating female component, each with mating surfaces (outer male surface, inner female surface), the surfaces each comprising electrically conductive rings and electrically insulating substances deployed between the conductive rings, each electrically conductive ring within each component being capable of being connected to an external device or devices.

The male component of the invention has a symmetrical generally cylindrical shape with at least a small diameter cylindrical tip part and a sloped or conically shaped larger middle part and optionally a large level diameter butt end part, and can have a connector ring or tip at its tip end.

The female component of the invention has a receptacle to mate with the male component so that the electrically conductive rings of the male component make electrical contact with electrically conductive rings within the female component when the male component is fully inserted into and engaged with the female component.

In each case, the electrically conductive rings may be of a narrower width than the width of the electrically insulating material deployed between the rings in order that no conductive ring on one component can contact more than one ring on the other component during insertion or removal of the male component into or from the female component.

The electrically conductive rings of the female component may be provided with spring connectors each of which resides within a trough formed on two sides by insulating material and the third by the inner surface of the electrically conductive ring to which it is installed, said spring connectors being compressed by the mating conductive ring of the male component when the male component is engaged with the female component, to provide a positive, dynamic electrical connection which is not susceptible to disconnection if vibrated or jostled or rotated male component against female component.

The mating spring connectors of the device deployed on the conical surface of the female component may be further compressed upon engagement of the male component with the female component, and held in such compression when the two components are clamped or held together when deployed. Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIG. 1 is a side elevation perspective drawing and matching cross-sectional cutaway of the invention installed in a drill string.

DETAILED DESCRIPTION

Overview

Figure 2C:
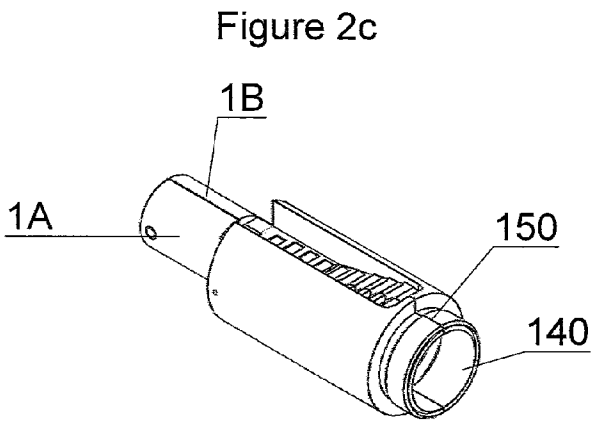
FIG. 2 shows the female component of the invention as a side elevation perspective drawing (FIG. 2*a*), a matching cross-sectional cutaway (FIG. 2*b*), and a perspective drawing (FIG. 2*c*)
Figure 2A:
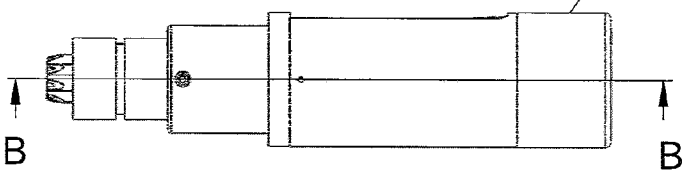

Generally, the present invention provides a multi-trace bayonet rotary connector which comprises a male 2 and female 1 component, the male component 2 having a series of ring connectors 200 deployed along its body 240, the body 240 having a profile in cross-section characterizable as having at least two and preferably three steps 250, 260, 270, which in order from the tip comprise: a level or flat slender step 250, and a conically sloped step transitioning from the diameter of the level step to a larger diameter 260, and optionally but preferably a larger diameter level step 270 being furthest from the body's tip 201. The sloped step 260 is configured in an embedded cone shape, the apex of which is toward the tip 201 of the male component 2. The female component 1 provides for a mating receptacle 140 to receive the male component's body 240, with spring connectors 100 arranged within the female receptacle 140 such that each spring connector 100 makes contact with one of the ring connectors 200 on the male component 2 when the male 2 and female 1 components are assembled together (FIG. 1).

The figures show an embodiment of a male 2 and female 1 component of the invention. Included on the female component 1 is a slot 145 into which the cabling 148 is deployed and a brass end piece 149 which is typically tightened on a threaded end 150 of the female component 1 to hold its two molded halves 1A, 1B together.

Note the conical shape of the male component 2. At the tip 201 in the embodiment shown, there are 3 rings of the same outside diameter 251, 252, 253 which in this embodiment carry DC or AC power or ground which circuiting is not as problematic if accidentally improperly connected during engagement or disengagement of the components 1 and 2 as would be the traces on the conical segment 260 of the connector.

It is to be noted that the connectors 200 on the male component 2 will not meet or touch the connectors 100 within the female component 1 until they 1, 2 are fully mated.

The wiring connectors 148 inside the female component 1 are laid in an internal slot 110 in the halves 1A, 1B and soldered to each of the connector rings 105 attached to connector springs 100 which are deployed along the inside 140 of the female component 1. The mechanical connection (by soldering, for instance) between the connector ring and the wiring connector in each case provides strong resistance against rotation of the connector ring in relation to the rest of the female component, and provides stability to the female component generally.

Similarly, mechanical connections between each connector ring and wiring component within the male component provide similar anti-rotational biases and stability. This is particularly so when/if the respective male or female component is filled with epoxy to become a monolithic structure, such that these mechanical connections add further to the integrity of the structure.

When making up the female component 1 of the connector, the body of which is molded in two pieces 1A, 1B, the conductor rings 105 are inserted into receiving slots 110 on one side piece 1A or 1B, then the other side element 1B or 1A is assembled to fit, engaging the rings and abutting the first side 1A or 1B element, which elements 1A, 1B are held together mechanically and can be then glued or epoxied; inner spring conductors 100 are inserted inside the cavity 140, and one or more end-caps 149 are secured to the female component 1 to hold the two halves 1A, 1B together.

The inner diameter of the female component's conductor rings 105 is slightly larger than the inner diameter of the cavity 110 formed by the insulative body elements 115 of 1A and 1B (aside from the ring-receiving slots 110), so that the shoulders in the body's cavity 149 next to each ring-receiving slot 110 will hold a spring conductor 100 adjacent and in contact with each conductor ring's 105 inner diameter surface.

Manufacture of the Female Component:

A first female half-shell 1A with grooves 110 into which spring-connector-rings 100 can be inserted is provided. The spring-connector-rings 105 are sized to have internal opening diameters smaller than the insulating material 115 of the half-shell 1A, 1B, 115 adjacent the groove 110 into which a spring-connector-ring 100 is to be placed. A lead wire is 148 attached to electrically connect (e.g. soldered) to each spring-connector-ring 105, and each spring-connector-ring 105 is placed within its groove 110 in the first female half-shell 1A or 1B. The leads are routed toward the tip or small-diameter end of the female half-shell T. A second female half-shell 1B or 1A providing insulation between each spring-connector-ring is mated to the first half-shell 1A or 1B, and the leads 148 are laid into a channel 160 into a chamber 165 at the tip-end T of the assembled half-shell 1A, 1B which forms the body of the female connector 1. The leads 148 are electrically connected (e.g. soldered) to a multi-lead connection assembly 170 (not necessarily shown). The multi-lead connection assembly may be sealed to the female component's body with a high-pressure resistant seal. The two half-shells 1A, 1B may be held together by a removable ring 149 or housing slid over either end of the conjoined half-shells. The lead wires 148 may be sealed into the conjoined half-shells 1A, 1B by injection of epoxy or similar hardening plastic material to make the female connector component's body a unitized body. Into the core of the female component's body 140, there is an essentially cylindrical opening with recessed spring-connector-rings' interior diametrical surfaces alternating with the internal radial surface of the between-rings insulator 115 provided by the profile of the half-shells' internal surfaces. These recessed spring-connector-ring spaces (at 100) receive mating circular spring connectors 100, which are installed into the provided recesses which are circumferential grooves, and held there by spring tension, in electrical contact with the spring-connector-rings' 105 inside surfaces.

The female component's half-shells 1A, 1B may have a slot 145 in its outer surface which exposes metal connector rings 105 connected to each of the spring-connector-rings 100 deployed on its inner surface, and into which a multi-trace cable 148 is laid, the end of each trace 148 having being soldered or otherwise connected to a single one of the spring connectors 105.

The slot in the outer surface of the female component, after the traces 148 are soldered or connected to the ring components 105, may be filled with a silicon, epoxy or other substance to protect and seal same.

It is to be understood that this is but one method of manufacturing the female component suitable for use in the invention described here, and is provided by way of example.

Manufacture of the Male Component:

A male connector shell 280 of insulating material is provided, with a first butt end B with an opening 281 to carry a multiple-lead connection 283 (not necessarily shown), and open conduits 284, 285, 286 from that opening to permit electrical leads (wires) 291-302 to connect from the multiple-lead connection 283 through the body of the male shell 280, each to a separate connector ring 200 deployed along a shaft 310 of the male shell 280 extending toward the shell's second or tip end T. A series of connector rings 200 of predesignated inner and outer diameter and width are each connected to a lead wire 291-302. One by one, and in a predesignated order, the connector rings 200 are slipped onto the shaft 310 of the shell 280 with the associated lead wire 291-302 being inserted into the appropriate conduit 284, 285, 286 etc. to the butt end B opening 281 of the shell 280; after each connector ring 200, an appropriately sized (inner and outer diameter, thickness) insulator ring 320 is slipped onto the shell's 280 shaft 310; and so on, until the last insulator ring 320 has been placed, after which a tip-connector 330 is installed with its lead-wire 302 connecting through the appropriate conduit 284, 285, 286 etc. to the butt end's B multiple-lead connection device 283. As noted above, the mechanical connection of the wiring connector to each connecting ring provides an added anti-rotational bias to the ring in relation to the male component as a whole, and provides added integrity to the male connector when the male connector is filled with epoxy and made into a unitized integral monolithic part. Also, similarly to the female component's multi-lead connection to external devices, the multi-lead connection assembly 283 may be sealed to the male component's body with a high-pressure resistant seal. The final tip-connector 330 may be screwed into or onto the shell's 280 shaft's 310 end T thus holding all of the conductor 200 and insulator 320 rings together on the shell 280. The shell's 280 conduits and openings may be filled with hardening plastic or epoxy or similar material to consolidate the components into a single unitary body.

The male component's shell 280 consists of a central core 281 with at least one shoulder 340 and a central body 310 and when assembled, extends through a number of connector rings 200 and insulator rings 320. On the central core are slots 350 within which other multi-trace leads 291-302 are laid, such that the leads 291-302 are not in contact with the connector rings 200 but rather are gathered in the slot 320 and in the core 281 and thus inside the inner diameter of both the connector 200 and insulator 320 rings. The leads 291-302 are sheathed in insulation except where soldered to the rings 200.

A nut 330 may be threaded onto the tip T of the male component shaft 310 to assist in holding the connector 200 and insulator 320 rings in place. Alternatively, the male component 2 may be assembled roughly, and then formed by injection or other molding techniques of suitable thermoset or other plastic material to form a unibody and may be further machined to become relatively exactly mateable with the female component 1.

It is to be understood that this is but one method of manufacturing the male component suitable for use in the invention described here, and is provided by way of example.

How the Connector Makes Electrical Connections:

The female component 1 will have a multiple-lead plug 170 or other mechanism by which each of leads 148 individually connected to one its spring connectors 100 may be in turn connected to an electronic or electrical device. For instance, the plug 170 might connect each lead 148 to a sensor pack's output leads and to a power supply's power and ground leads. The female component 1 may then be attached to a tool for use downhole within a drillstring (as in FIG. 1), the tool in turn may be detached but re-attachable to a drillstring, which is typically done by rotating threaded connectors which are at the ends of component parts of the drillstring. The male component 2 will also have a multi-lead plug 283 (or similar device) by which each of its leads 291-302 may be attached to a transponder, memory, or other device, which in operation downhole requires that electrical connections be made between the transponder (for example) and the sensor pack (in the other part of the drillstring). In order to attach and detach the two components (in this example, the sensor pack and the transponder pack), the male connector 2 is inserted into the female component 1, and the spring connectors 100 of the female component 1 make contact with the ring connectors 200 of the male component 2. The connection can be made by simple linear insertion, but the connector components can be rotated (by reference to each other) to permit, for example, assembly of other parts of the drillstring or tools on the string. Typically, the female 1 and male 2 components would be operatively connected, and held together by each being assembled inside a housing with two halves which, when locked, hold the female and male components together in compression (as in FIG. 1).

Operational Considerations:

The male component 2 (and by inference the mating receptacle portion of the female component 1) may have connectors 200 on any or all of the different profiles 250, 260, 270 comprising its shape, but preferably will have ground or power traces supplied at the level portions 250, 270 of the profile, and sensitive or data traces supplied at the conical or sloped portion 260 of the profile.

During assembly of the two components 1, 2 together to make dynamic electrical connection, the male 1 component's level tip 250 section acts as a centering device; during insertion it may make connection with a spring conductor 100 within the receptacle of the female component, but the contacts on the conical or sloped profile 250 portion of the male component 2 will not make electrical contact or connection with any spring connector 200 except the spring connector with which it is designed to mate; similarly, conductors on the largest diameter 270 flat portion of the male 2 component's profile will not make contact with any spring connector 200 in the female receptacle 1 but those which are deployed on the mating portion of the female receptacle.

If desired, the width of each electrically conductive ring on the male component 200 will be designed to be less than the width of the non-conductive surface between selected pairs of adjacent spring connectors 100 within the female component so that those spring connectors 100 will not be shorted by any conductive ring 200 during insertion of the male component; particularly on the level portion(s) 250, 270 of the male component 1 and the mating level portions of the female receptacle.

Additionally, the sloped outer surfaces 260 of the two components 1, 2 may be forced into close contact by application of linear force on the outer ends B, T of the two components 1, 2; this is advantageous, as the linear force may be relied upon to keep the connectors 200 and springs 100 in physical contact and good electronic connection despite and during harsh vibration or impact forces on the bayonet connector.

The present device may be built to provide reliable and adequate electrical connectivity with up to about 10 circuits or traces and still have an overall length of around 7-10 inches, while conventional connectors with similar trace counts are in the range of 20 inches and longer, end-to-end (B-T).

In a preferred embodiment, the tip connector 330 of the male component 2 (and the mating spring connector of the female component) would be a ground or common circuit, to allow that to mate first on connection and disconnect last on removal, and to be disconnected prior to any powered ring 200 or spring 100 connector (in particular on any of the level segments 250, 270 on the components' mating surfaces) wiping across any other spring 100 or ring 200 connector during engagement or disengagement of the components 1, 2. The tapered conical section 200 is designed to allow for the tip 330 (ground or common) section to not contact any other connector 100, and the tapered design permits a large surface-area for dynamic positive surface connection around 360 degrees of the component's springs 100 and rings 200. In addition, those connector springs 100 and rings 200 on the tapered section 260 may be held together in compression when the components are engaged and locked while in use (by external brackets or devices not discussed specifically here), for example clamped together within a thread-tightened enclosure (as in FIG. 1); this provides positive connection for environments which have, as an example, high amounts of vibration. Another feature is that the design, being short with at least 2 and perhaps 3 (or more) stepped or conical internal interfaces (between the male and female mating surfaces) minimizes flex within the connector's body, but will allow consistent electrical connections to be maintained if there were slight flex or movement, as the connectors' springs 100 and rings 200 are held in compression, and the contact springs 100 may have a compression load, preferably of about 1 pound.

The width of the connection rings 200 and springs 100 permit some tolerance of slight misalignment or flex of the components during use, while providing for a shorter than conventional rotary connector.

Signals carried on the lower tapered regions 260 of the components may be, for example, 5 volt dc logic signals, typically 1 milliamp; the first 3 contact pairs 251, 252, 253 after the common or ground at the tip T may be 24 volt DC power conduits of approximately 10 amps. The last contact pairs (on the fat level end of the male connector 270, if present) may not be used, but if used could be for logic or power voltage levels, preferably for higher power levels as their larger mating surface area would provide more current amp conductive capacity.

The small diameter level tip segment 250 with the tip connector 330 is designed to provide alignment guidance for the proper engagement of the male 2 and female 1 components. The placement of the tip connector 330 provides isolation of ground or common connections from being made during engagement of the components. The sloped, ramped or conical segment's 260 ring 200 and spring 100 widths and placement vis a vis the width and order of the insulators 320 between adjacent rings 200 or adjacent springs 100 prevents transient contacts during engagement activities from being made, and provides for positive contact being made and maintained by compressive forces holding the male and female components together during use.

This arrangement has several advantages:

1. By virtue of the conical structure, during the insertion and removal of the male component from the female component none of the traces within the conical section slide against or are connected with any of the other traces, and when the connection is made the connection is made properly between all circuits roughly simultaneously. This overcomes the non-conical connector problem of multiple shorts and undesirable connections being made while a level or multi-stepped male element is slid into, and thus in connection with, a level or multi-step female component
2. Conventional multi-traced bayonet rotary connectors of this type have had a male body with a threaded rod or bolt with an insulating sleeve inserted through a body and a nut at the external terminus holding connector rings and insulator rings tightly against the body of the unit. Being made of a threaded rod, the central core of the tip section of the male component can not carry the multi-traced cable, and therefore those cables have traditionally been deployed through holes drilled and spaced, one per trace, in the body of each connector and insulator ring. This has the disadvantage of causing intermittent or permanent shorts or loss of connection when the rings are mechanically shifted and contact or cut the traces, such as when the connector is under some angular stress, or when one side of the connector is twisted radially or torqued versus the other side. If intermittent, those types of misconnections are difficult or impossible to find.
3. Having the spring connectors deployed in the inside of the female connector protects those springs from damage during handling or deployment or shipment, as opposed to having the spring connectors on the male side of the connector, where they are exposed during shipment or transport or storage.
4. The female component, once assembled, is a one piece unit, thus being simpler to manufacture and handle.
5. This invention is typically made of a 30% glass filled core, with higher strength and better electrical properties, and a lower co-efficient of expansion differential between the metal and insulated parts, providing for better durability in use in extreme environments.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

LEGEND FOR DRAWINGS

Figure 2B:
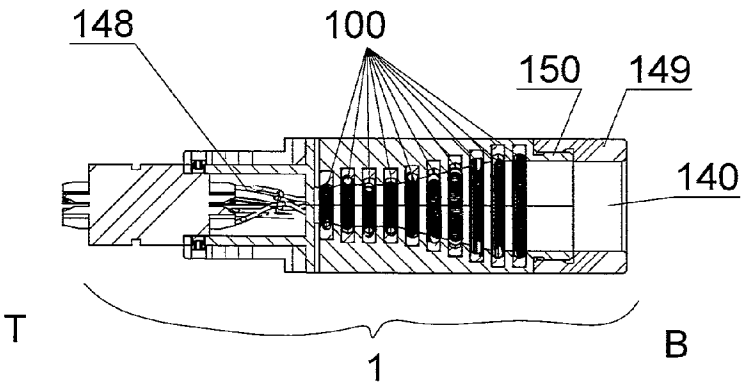
Figure 3B:
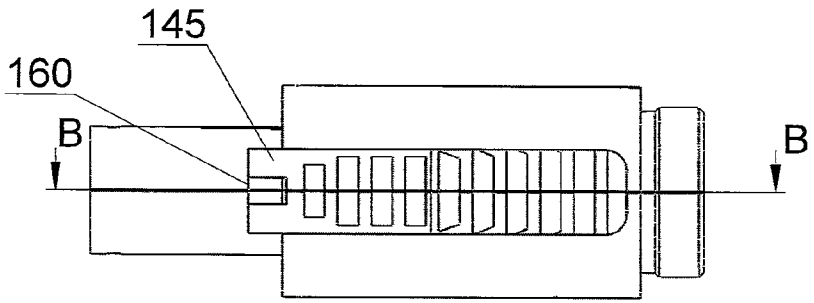
FIG. 3 shows a top elevation of the female component of the invention (FIG. 3*b*) with a cross-section along an axis of the top elevation (FIG. 3*a*).
Figure 3A:
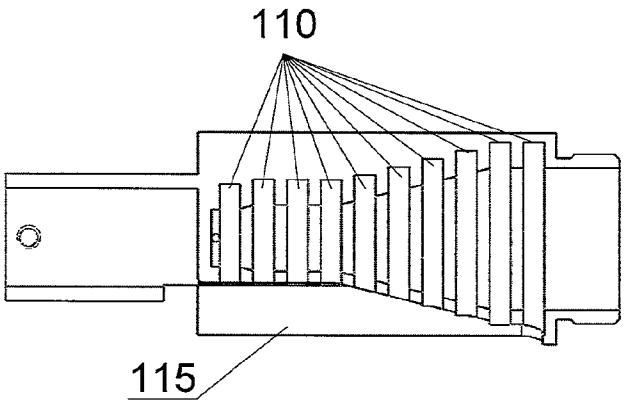
Figure 4A:
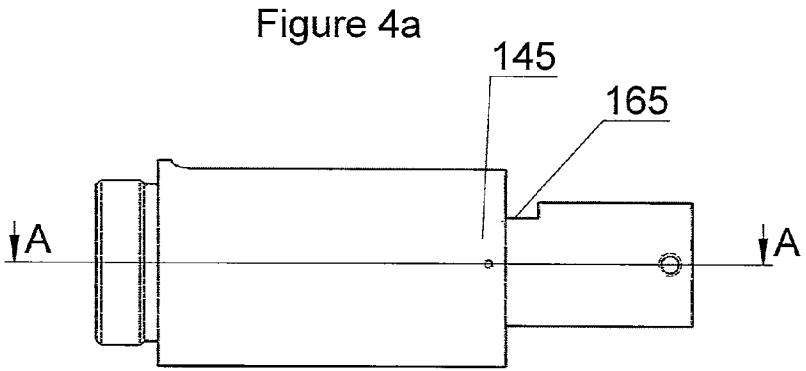
FIG. 4 shows a side elevation of the female component of the invention (FIG. 4*a*) with a cross-section along an axis of the side elevation (FIG. 4*b*)
Figure 4B:
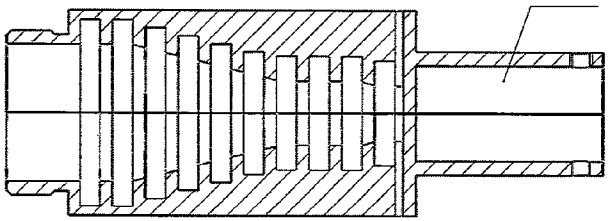
Figure 5C:
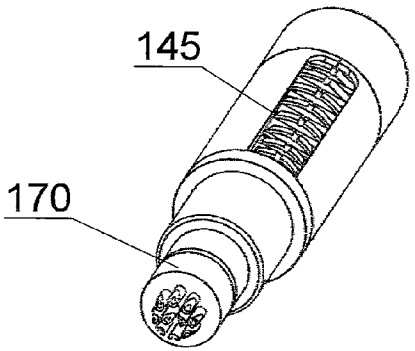
FIG. 5. Shows a top elevation perspective drawing of the female component of the invention, assembled (FIG. 5*a*) together with a cross-section along an axis of the top elevation (FIG. 5*b*) and a perspective drawing of the female component (FIG. 5*c*)
Figure 5A:
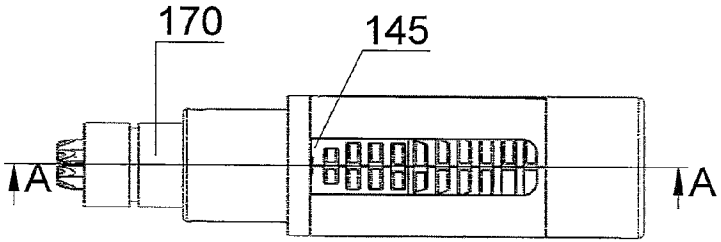
Figure 5B:
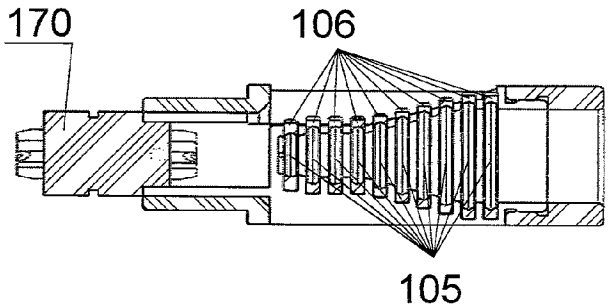
Figure 6C:
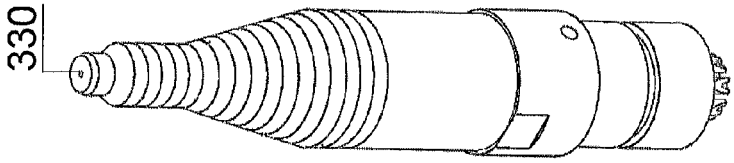
FIG. 6 shows a side elevation perspective drawing of the male component of the invention, assembled (FIG. 6*a*), a cross-section of the same component (FIG. 6*b*) and a perspective drawing from an angle showing a 3-dimensional aspect of the same male component (FIG. 6*c*)
Figure 6A:
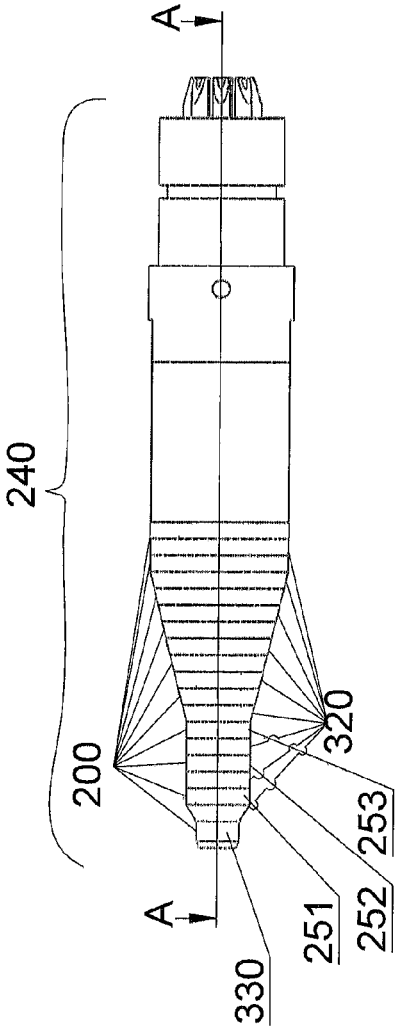
Figure 6B:
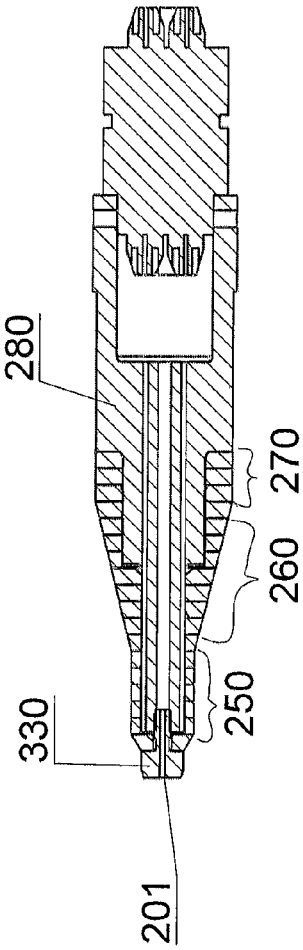
Figure 7A:
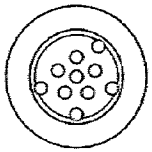
FIG. 7 is a series of images of the male connector's shell, being: a butt-end end elevation (FIG. 7*a*), a side elevation (FIG. 7*b*), a tip-end end elevation (FIG. 7*c*), a longitudinal cross-section (FIG. 7*d*), and a perspective drawing in 3D (FIG. 7*e*)
Figure 7B:
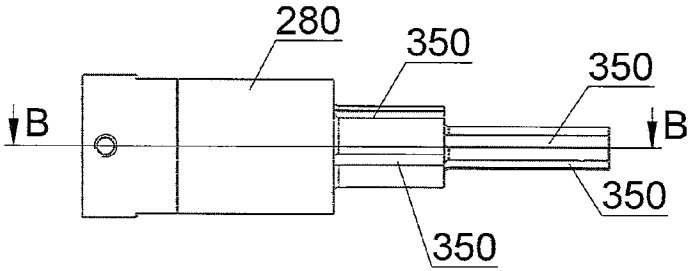
Figure 7C:
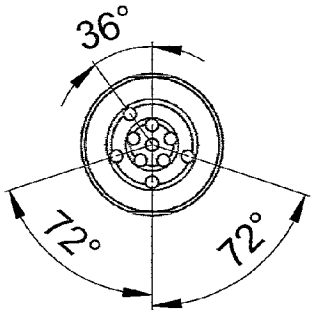
Figure 7D:
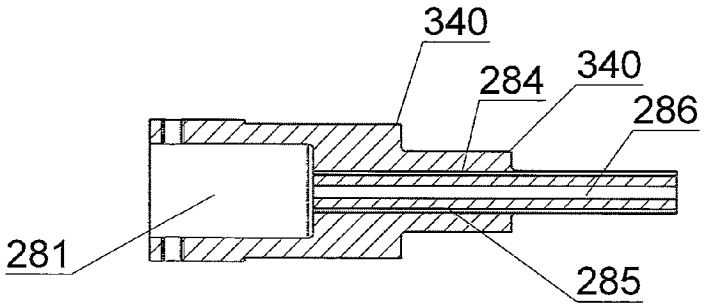
Figure 7E:
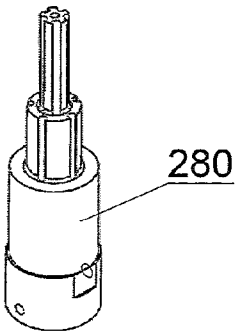
Figure 8:
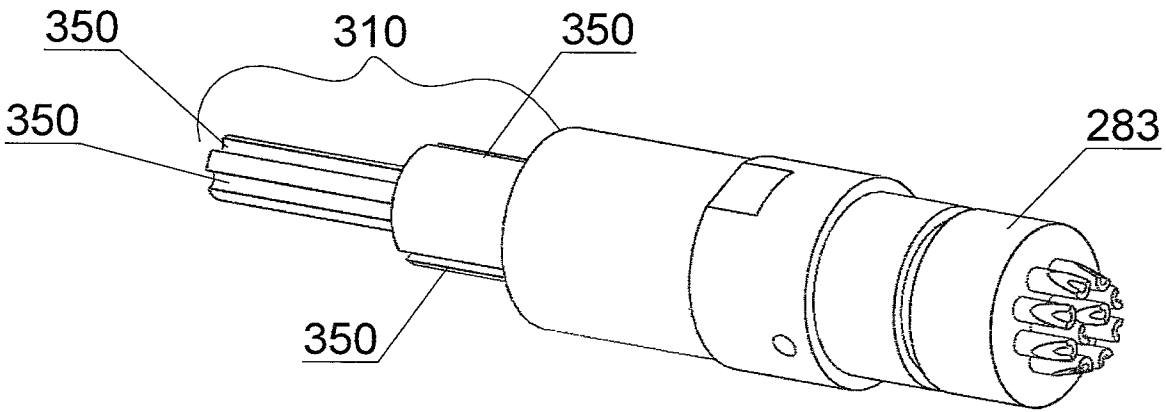
FIG. 8 is a transparent perspective drawing showing the wiring harness in place with respect to the male connector shell.
Figure 9A:
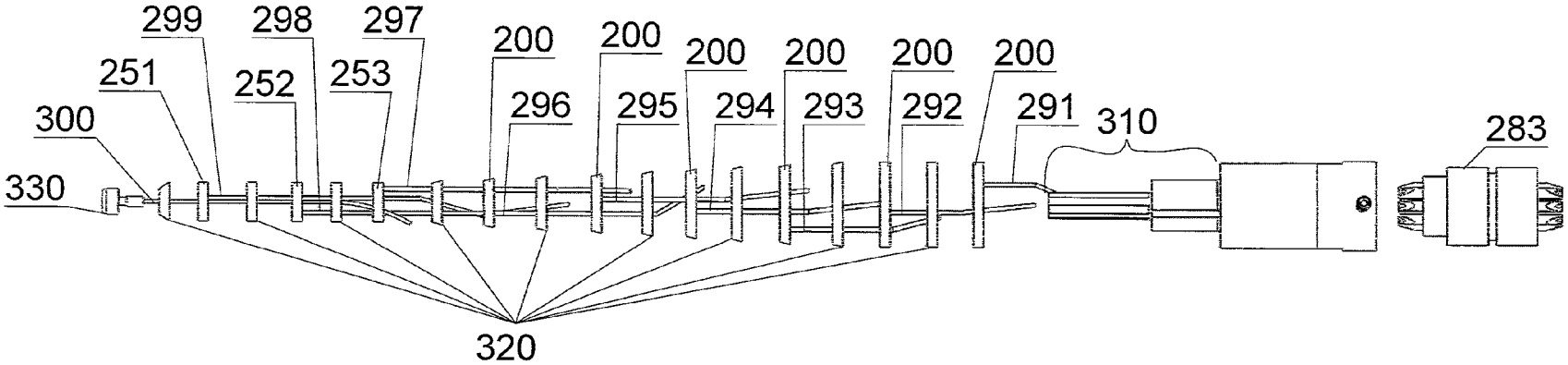
FIG. 9 is an exploded view (FIG. 9*a*) and an assembled view (FIG. 9*b*) of the male connector to portray the relative positions of connecting rings, wiring, the shell and the wiring contact elements of the male connector.
Figure 9B:
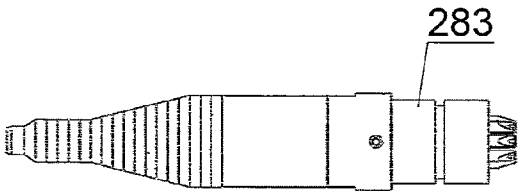

| Number | Feature |
|---|---|
| T | Tip-end of the assembled half-shell 1A |
| B | First butt end of male connector shell Figure 2b |
| 1 | Female Component |
| 2 | Male Component |
| 1A | Part of Body of Female Component 1 |
| 1B | Part of Body of Female Component 1 |
| 100 | Spring Connectors |

-continued

LEGEND FOR DRAWINGS

| Number | Feature |
|---|---|
| 105 | Connector Rings |
| 110 | Internal Slot |
| 115 | Insulative Body Elements |
| 140 | Mating Receptacle/Cavity |
| 145 | Slot |
| 148 | Wiring Connectors/Cabling/Lead Wire/Multi-trace Cable |
| 149 | Brass End Piece |
| 150 | Threaded End of Female Component 1 |
| 160 | Channel |
| 165 | Chamber |
| 170 | Multi-lead Connection Assembly |
| 200 | Ring Connectors |
| 201 | Body's Tip |
| 240 | Male Component Body |
| 250 | Flat Slender Step |
| 251 | Outside Diameter Of The Tip Of Male Component 1 |
| 252 | Outside Diameter Of The Tip Of Male Component 1 |
| 253 | Outside Diameter Of The Tip Of Male Component 1 |
| 260 | Conically Sloped Step Transitioning From The Diameter Of The Level Step To A Larger Diameter |
| 270 | Larger Diameter Level Step |
| 280 | Male Connector Shell |
| 281 | Opening |
| 283 | Multiple-Lead Connection |
| 284 | Open Conduit |
| 285 | Open Conduit |
| 286 | Open Conduit |
| 291 | Electrical Leads (Wires) |
| 292 | Electrical Leads (Wires) |
| 293 | Electrical Leads (Wires) |
| 294 | Electrical Leads (Wires) |
| 295 | Electrical Leads (Wires) |
| 296 | Electrical Leads (Wires) |
| 297 | Electrical Leads (Wires) |
| 298 | Electrical Leads (Wires) |
| 299 | Electrical Leads (Wires) |
| 300 | Electrical Leads (Wires) |
| 301 | Electrical Leads (Wires) |
| 302 | Electrical Leads (Wires) |
| 310 | Shaft |
| 320 | Insulator Rings |
| 330 | Tip-Connector |
| 340 | Shoulder |
| 350 | Slots |

What is claimed is:

1. A bayonet rotary connector for making and breaking multiple electrical connections when respectively plugged and unplugged comprising:

a. a monolithic male component and b. a monolithic female component each with mating surfaces (outer male surface, inner female surface) also comprising:

c. electrically conductive rings, and d. electrically insulating substances deployed between the conductive rings, each electrically conductive ring within each component being capable of being connected to an external device or devices, where the male component has a symmetrical generally cylindrical shape with at least a small diameter cylindrical tip part and a sloped or conically shaped larger middle part, with increasing diameter in the direction away from the tip part, and optionally a large level diameter butt end part.

2. The bayonet connector of claim 1, where the male component also has a connector ring at its tip part.

3. The bayonet connector of claim 1, where the female component has a receptacle to mate with the male component, the electrically conductive rings of the male component making electrical contact with the electrically conductive rings of the female component when the male component is fully inserted into and engaged with the female component.

4. The bayonet connector of claim 1 where a mechanical connection between any electrically conductive ring and an associated electrically conductive cable provides an anti-rotation bias to that ring.

5. The bayonet connector of claim 1 where the electrically conductive rings are of a smaller width than the width of the electrically insulating material deployed between the rings, in order that no conductive ring on one component can contact more than one ring on the other component during insertion or removal of the male component into or from the female component.

6. The bayonet connector of claim 1, where the electrically conductive rings of the female component are provided with spring connectors each of which resides within a trough formed on two sides by insulating material and the third by the inner surface of the electrically conductive ring to which it is installed, said spring connectors to be compressed by the mating conductive ring of the male component when the male component is engaged with the female component, to provide a positive, dynamic electrical connection which is not susceptible to disconnection if vibrated or jostled.

7. The bayonet connector of claim 1 where the mating spring connectors of the device deployed on the conical surface of the female component are further compressed upon engagement of the male component with the female component, and held in compression when the two components are clamped or held together when engaged.

8. The bayonet connector of claim 6 where each spring connector is field replaceable.

9. The bayonet connector of claim 1 where the outer end of each component is sealed around a multi-lead feedthrough permitting multiple electrical connections through cables each connected to one ring communicating from the ring back through the connector component to its outer end through the feedthrough, the seal being capable of withstanding high fluid pressure to keep fluid from invading the bayonet connector.

10. The bayonet connector of claim 1 where the male component is constructed by assembling the connector rings, each mechanically connected to a wire, onto a central assembly body, the body having a profile to slide within the inner diameter of the rings and with a passageway to accommodate each wire communicating from the associated ring's final position through the assembly body and out through the outer end of the male component, each connector ring being interspersed with an insulating ring with matching outer diameter, such that when stacked and fully assembled, the outer surfaces of the connector rings and insulating rings form the outer profile of the male assembly; connecting the wires to a multi-conductor plug; the multi-conductor plug being sealed to the assembly body to form a high-pressure seal; the rings, wires and plug being formed into a unitized or monolithic structure.

11. The bayonet connector of claim 10 where the monolithic structure is obtained by injecting epoxy or similar hardening fluid into cavities of the assembled structure and hardening the fluid.

12. The bayonet connector of claim 1 where the end of cylindrical tip part is a ground or common circuit.

* * * * *